US006920807B2

(12) United States Patent
Bond

(10) Patent No.: US 6,920,807 B2
(45) Date of Patent: Jul. 26, 2005

(54) CROWBAR TOOL

(76) Inventor: William Ralph Bond, 4745 Asdee La., Woodbridge, VA (US) 22192

( * ) Notice: Subject to any disclaimer, the term of this patent is extended or adjusted under 35 U.S.C. 154(b) by 0 days.

(21) Appl. No.: 10/654,021

(22) Filed: Sep. 4, 2003

(65) Prior Publication Data

US 2005/0051001 A1 Mar. 10, 2005

(51) Int. Cl.[7] ..... E04D 15/00
(52) U.S. Cl. ..... 81/45; 254/131.5; 30/169
(58) Field of Search ..... 81/45; 254/131.5; 30/169, 172; 299/36.1

(56) References Cited

U.S. PATENT DOCUMENTS

| | | | | |
|---|---|---|---|---|
| 178,053 A | | 5/1876 | Frank | |
| 436,167 A | | 9/1890 | Slocum | |
| 1,082,952 A | * | 12/1913 | Hobbs | 7/143 |
| 3,228,720 A | * | 1/1966 | Jordan | 294/65.5 |
| 5,280,676 A | * | 1/1994 | Fieni | 30/172 |
| D439,126 S | * | 3/2001 | Gohman | D8/89 |
| D444,690 S | | 7/2001 | Bond | |
| 6,453,774 B1 | * | 9/2002 | Khachatoorian | 81/45 |

* cited by examiner

*Primary Examiner*—Joseph J. Hail, III
*Assistant Examiner*—Alvin J. Grant
(74) *Attorney, Agent, or Firm*—Palmer C. DeMeo

(57) ABSTRACT

A crowbar tool is disclosed for construction use and particularly for carpentry and roofing work. The crowbar tool has an elongated metal bar with a plurality of extraction teeth at one end of the metal bar and a handle to which the opposite end of the metal bar is attached. Attached to the handle, near the attachment of the metal bar, is a hook or angled element which hook or angled element facilitates the removal of shingles, tiles and carpets whereby, during their removal process, they slide over the hook or angled element without being obstructed by the handle. The crowbar tool also has several permanent magnets attached to the handle thereof for picking up loose nails, staples or other small metal objects.

36 Claims, 2 Drawing Sheets

CROWBAR TOOL

BACKGROUND OF THE INVENTION

1. Field of the Invention

The present invention relates to a crowbar tool especially useful in the removal of roof shingles and nails. The crowbar tool can also be used for the removal of floor tiles and carpets.

2. Description of the Related Art

There are a number of tools which have been used by construction workers and roofers for the removal of nails holding down shingles, tiles, carpet, etc. The Slocum patent (U.S. Pat. No. 436,157) discloses a tack puller for removing tacks, nails, etc., from carpets, flooring, or other objects into which they have been driven. The Slocum tack puller comprises a handle A, a claw C secured at one end of the handle A by means of a screw D which also acts as a fulcrum. The Frank patent (U.S. Pat. No. 178,053) discloses a nail extractor comprising a handle or bar A, a crow-foot B and a toe E attached to the bar A at the crow-foot end of the bar A. The Framk patent discloses that the toe E serves as a fulcrum. The Hobbs patent (U.S. Pat. No. 1,082,952) discloses a nail puller and scraper comprising a handle 17, 18 into which is secured a bar 10 of metal at one end of which is a claw 11. The Hobbs patent also discloses that the nail puller has a hammer 13 which also serves as a fulcrum and a scraper 14. The Bond design patent (D444,690) discloses a crowbar having several teeth at both ends of the tool and an eyelet near one end of the tool. The Jordan patent (U.S. Pat. No. 3,228,720) discloses a hammer 10 including a magnet 19 at one end of the handle 11 for picking up loose nails. The Khachtoorian patent (U.S. Pat. No. 6,453,774) discloses a shingle remover 10 comprising a handle 12 and a working end 20 with a plurality of teeth 20d and an eyelet 26.

SUMMARY OF THE INVENTION

The crowbar tool of the present invention has a metal bar attached to a lower end of a handle with several teeth at one end of the metal bar for the quick removal of old shingle(s) from a roof and the nails which secure them to the roof. The crowbar tool can also be used to remove tiles or carpet from a floor. The crowbar tool has an eyelet in the metal bar near the teeth. As is well known in the construction art, the eyelet can remove nails with broken heads. The crowbar tool has a hook or angled element at the lower or front end of a handle to facilitate the removal of roof shingles, tiles or carpet. The hook or angled element will provide a smooth guide for the shingles, tiles or carpeting during the removal process. For example, the lower end of the handle will not obstruct the removal of shingles from a roof or the removal of tiles or carpeting from a floor. The hook or angled element on the lower or front end of the handle may also be used for pulling construction materials or demolition materials. The crowbar tool also has permanent magnets attached to the handle thereof for picking up metal fasteners such as loose nails or staples as well as other small metal objects. Permanent magnets are attached at the front and rear ends of the handle for the crowbar tool. A permanent magnet in the rear or butt end of the handle enables the user to walk around and pick up loose nails, staples and other small metal objects while standing up. The worker no longer needs to bend over to pick up such metal objects from the work area.

Thus, it is an object of this invention to provide a crowbar tool which has general utility in the construction or carpentry fields.

It is another object of this invention to provide a tool to facilitate the removal of roofing shingles, floor tiles and carpets.

Yet, another object of this invention is to provide a tool which facilitates the unobstructed removal of roofing shingles, floor tiles and carpets.

It is another object of this invention to provide a tool which can be used to pull or haul construction or demolition materials.

It is a further object of this invention to provide a tool which also has magnets attached to the handle thereof for picking up loose nails, staples or other small metal objects from the work area.

Other objects and advantages of the use of the crowbar tool of this invention will become apparent upon reading the following description, of which the attached drawings form a part.

DETAILED DESCRIPTION OF THE PREFERRED EMBODIMENTS

Figure 1:
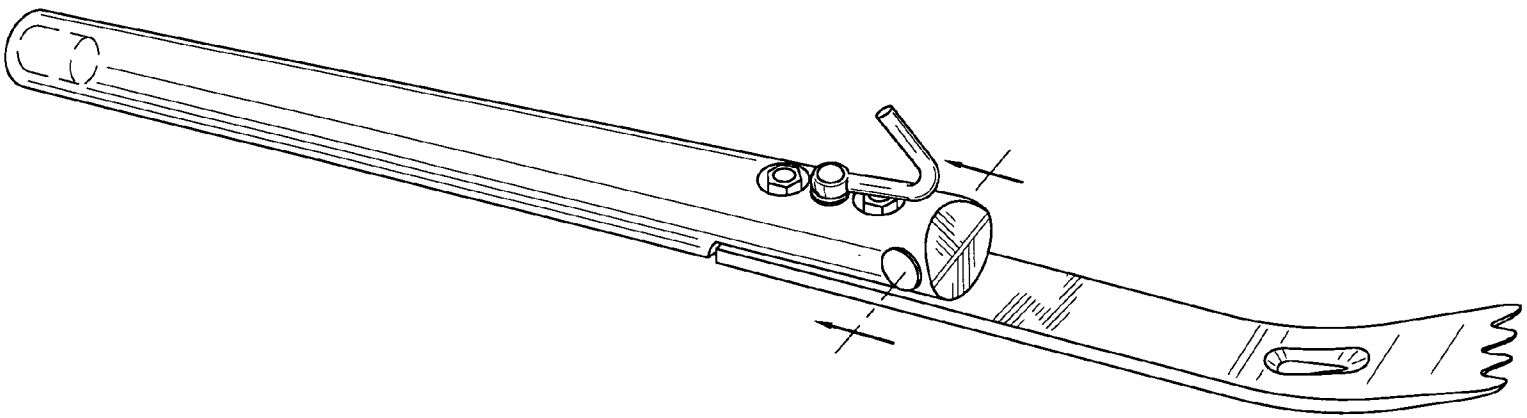
FIG. 1 is a perspective view of the crowbar tool of this invention.
Figure 2:
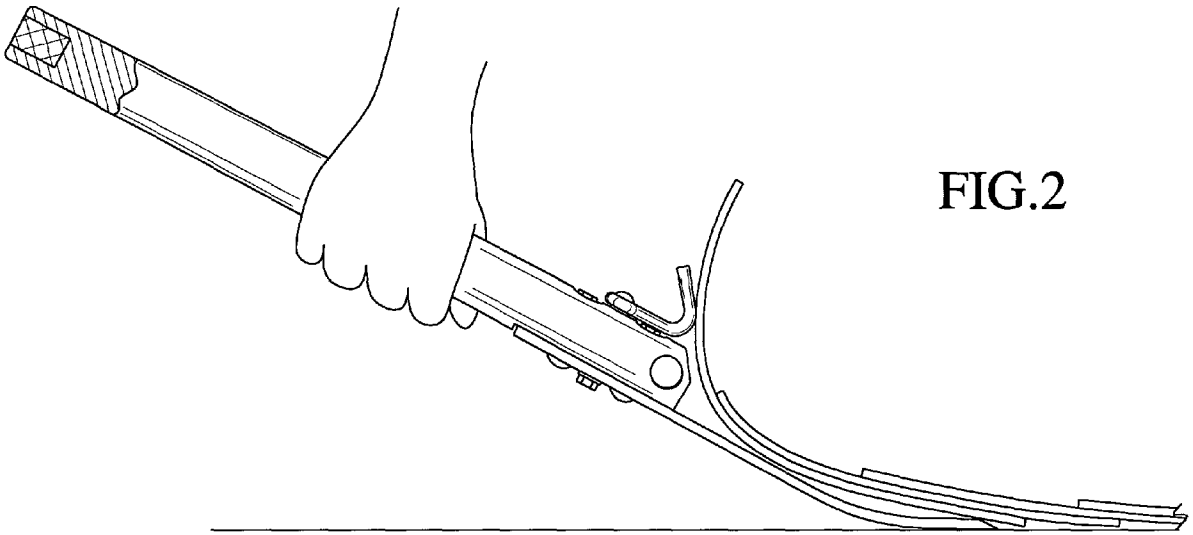
FIG. 2 depicts an application of the crowbar tool of this invention in the removal of roofing shingles.

Referring to FIGS. 1 and 2, there is shown a crowbar tool 1 of this invention. The crowbar tool 1 comprises a metal bar 2 having several teeth 3 at the free end thereof and an eyelet 4 near the free end thereof. The metal bar 2 is made from tempered steel but other strong and durable metals may also be used. The metal bar 2 is approximately 12 inches long and is substantially flat along a major portion of its length, slightly curved at about the location of the eyelet 4 and then extends to a set of four extraction teeth 3. However, the number of teeth may vary somewhat. The width of the metal bar 2 along its substantially flat portion is approximately 1 and ⅜ inches and gradually increases to the tip of its toothed end to approximately 1 and ¾ inches. The crowbar tool 1 has a handle 5 which has a front end 6 and a rear or butt end 7. The front end 6 of the handle 5 is tapered at its upper section 9 at approximately 60 degrees. The fixed end of the metal bar 2 (approximately 4 inches long) is attached to a flattened portion 8 of the handle 5 by three bolts 10, 11 and 12 and corresponding nuts 13, 14 and 15. The handle 5 is made from hard wood such as hickory or oak but other hard woods or even metal may also be used. The handle 5 is circular in cross section along its entire length and is approximately 22 inches long but may vary from this dimension. The diameter of the handle 5 is approximately 1 and ⅜ inches. The handle 5 may have indentations therein for better gripping purposes. Attached to the center bolt 11 and nut 14 is a hook or angled element 16 having two legs 17 and 18 connected by a curved center portion 19 and a circular eyelet 20 connected to the lower leg 18. The overall length of the hook or angled element 16 is approximately three inches excluding the eyelet 20. Each leg 17 and 18 is approximately one inch in length and the curved center portion 19 is approximately one inch in length. The upper leg 17 is bent rearwardly at an angle of approximately 60 degrees with respect to the longitudinal axis of the handle 5. However, this angle may vary plus or minus a few degrees. The circular eyelet 20, attached to the lower leg 18, passes through bolt 11 as shown in FIGS. 1 and 2. The hook or angled element 16 is made from chrome-plated steel but may also be made from other strong and durable metal or even from a hard plastic material. The hook or angled element 16, in the preferred embodiment, has a circular cross-section 5/16 inch in diameter. Other cross-sectional shapes for the hook or angled element 16 are also possible such as square, hexagonal, etc. The hook or angled element 16 may be oriented in a different position, for example, at 90 degrees from that shown in FIGS. 1 and 2 by first loosening and then tightening the bolt 12 and nut 14. With this orientation of the hook or angled element 16, the crowbar tool 1 may be gripped on opposite sides of the hook or angled element 16 for the purpose of hauling or pulling construction materials.

Figure 4:
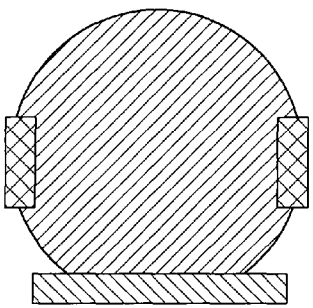
FIG. 4 shows a cross sectional view 4—4 through two disc shaped magnets in the handle of the crowbar tool of this invention.
Figure 3:
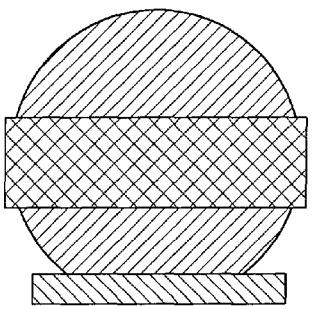
FIG. 3 shows a cross sectional view 3—3 through a cylindrical magnet in the handle of the crowbar tool of this invention.
Figure 1:
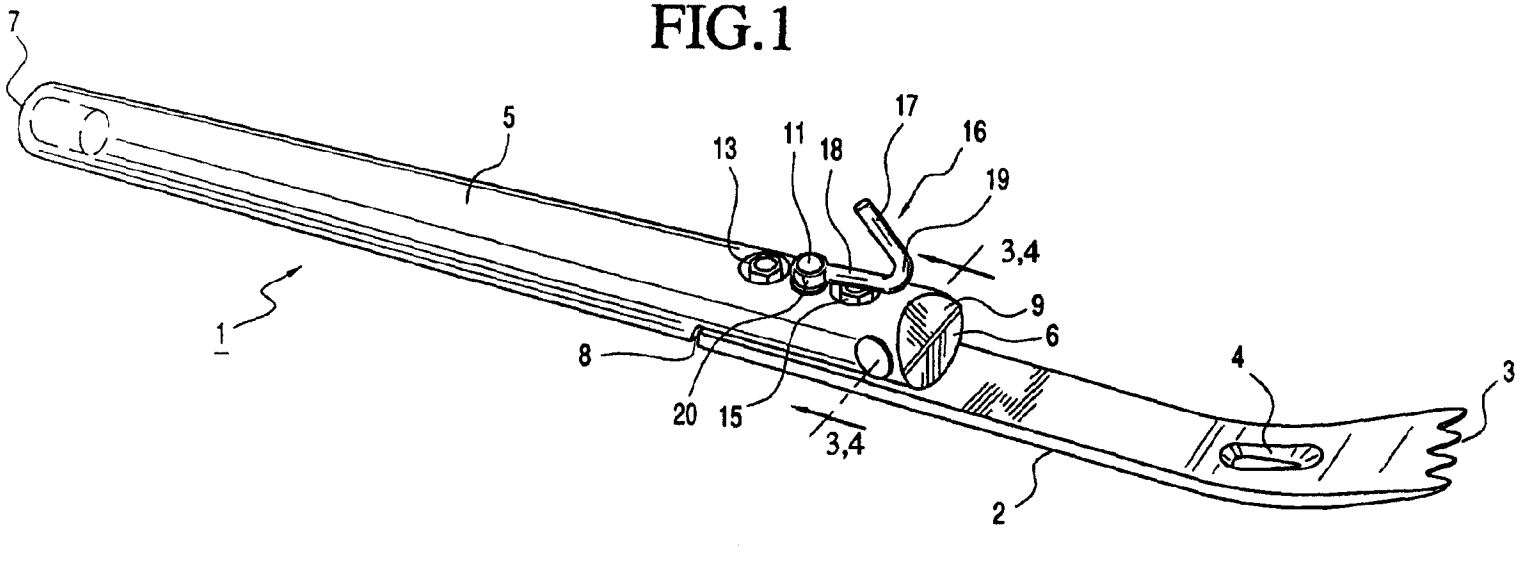
Figure 2:
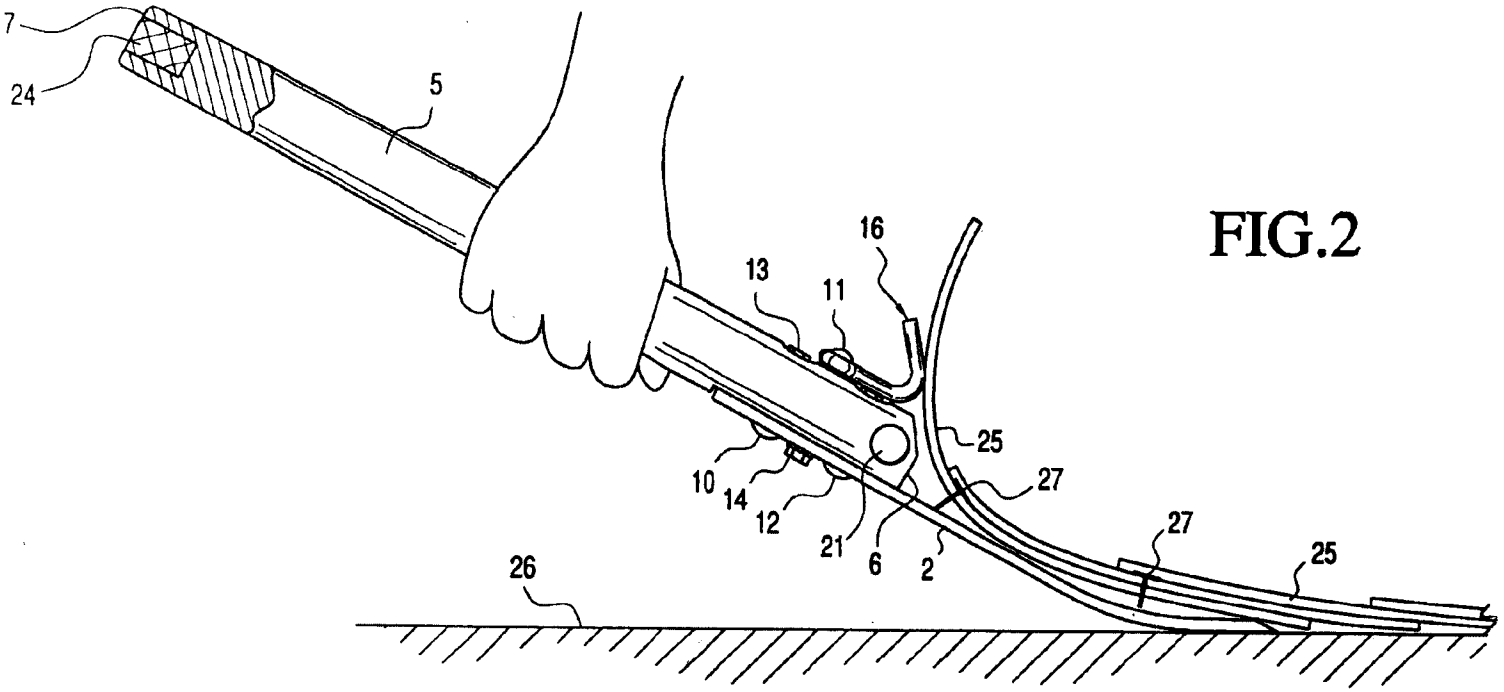
Figure 4:
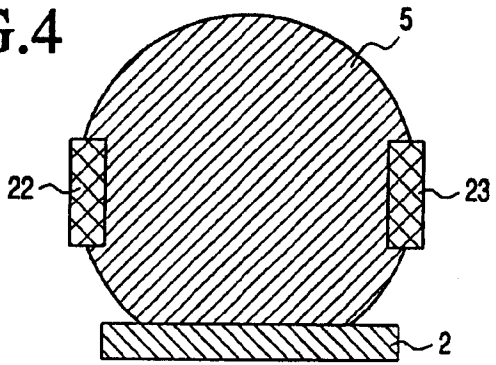
Figure 3:
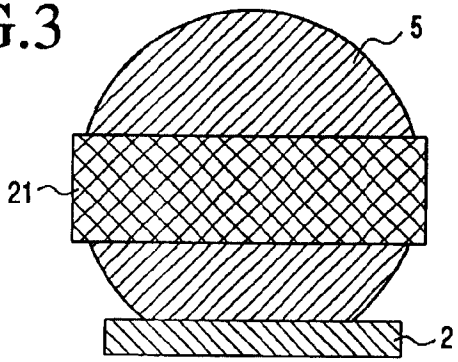

As shown in FIGS. 1, 2 and 3, a cylindrically shaped permanent magnet 21 is attached near the front end 6 of the handle 5. A suitably sized hole is drilled in the handle 5 and the cylindrically shaped permanent magnet 21 is inserted into the hole and held therein by a force fit or suitable adhesive. Alternatively, as shown in FIG. 4, a pair of disc shaped permanent magnets 22 and 23 are attached near the front end 6 of the handle 5 by countersunk opposing holes in the handle 5. The disc shaped permanent magnets 22 and 23 are then fixed to the handle 5 by a force fit, an appropriate adhesive or other suitable means. Although the cross-sectional shape of the permanent magnets 21, 22 and 23 is circular, other cross-sectional shapes for these permanent magnets can also be used, such as, square, rectangular, hexagonal, etc. Another permanent magnet 24 is inserted into the rear or butt end 7 of the handle 5 as shown in dashed lines in FIG. 1 and in cross-section in FIG. 2 of the drawings. The permanent magnet 24 has a circular cross-section but may also take other cross-sectional configurations such as square, rectangular, hexagonal, etc. The permanent magnet 24 may be attached to the butt end 7 of the handle 5 in a manner similar to permanent magnets 21, 22 and 23. Additional permanent magnets may also be attached to the handle 5 if so desired. The purpose of these permanent magnets 21, 22, 23 and 24 is to pick up loose nails, staples or other small metal objects from the work area. In particular, the permanent magnet 24 at the butt end 7 of the handle 5 may be used by the construction worker for picking up loose nails, staples and/or other small metal objects in the work area without the worker having to bend over or stoop down.

FIG. 2 of the drawing shows one example of the use of the crowbar tool 1 of the present invention, and that is, the removal of shingles 25 from a roof 26. The toothed end 3 of the crowbar tool 1 is slid under the shingles 25 and forced forwardly such that the nails 27 (two of which are shown in the figure) holding down the shingles 25 to the roof 26 are extracted along with the removal of the shingles 25 as the shingles are slid backwardly along the bar 2 and upwardly over the hook or angled element 16.

Modifications of this invention will be readily apparent to those skilled in the art and it is intended that the invention be not limited by the embodiments disclosed herein but that the scope of the invention be defined by the appended claims.

What is claimed is:

1. A crowbar tool comprising an elongated metal bar attached to an elongated handle, said elongated handle having a longitudinal axis, said metal bar having a free end and a fixed end, said metal bar having a plurality of extraction teeth at said free end, said fixed end of said metal bar being attached to one end of said elongated handle by securement means, a hook being attached to said handle by said securement means and wherein said hook has a leg with a free end which leg is angled with respect to said longitudinal axis in a direction rearwardly from said free end of said metal bar.

2. The crowbar tool as claimed in claim 1 wherein said hook has a circular cross-section.

3. The crowbar tool as claimed in claim 1 wherein there is an eyelet in said elongated metal bar near said free end thereof.

4. The crowbar tool as claimed in claim 1 wherein said securement means includes at least one pair of a bolt and nut.

5. The crowbar tool as claimed in claim 4 wherein said hook is attached to one pair of said at least one pair of a bolt and nut.

6. The crowbar tool as claimed in claim 1 wherein said elongated handle has at least one permanent magnet attached thereto.

7. The crowbar tool as claimed in claim 6 wherein said at least one permanent magnet is attached to said one end of said elongated handle.

8. The crowbar tool as claimed in claim 5 wherein said elongated handle has a butt end opposite to said one end and said at least one permanent magnet is attached to said butt end of said elongated handle.

9. The crowbar tool as claimed in claim 1 wherein said hook is made from metal or hard plastic material.

10. A crowbar tool comprising an elongated metal bar attached to an elongated handle, said elongated handle having a longitudinal axis, said metal bar having a free end and a fixed end, said metal bar having a plurality of extraction teeth at said free end, said fixed end of said metal bar being attached to one end of said elongated handle by securement means, and an angled element having two legs which are connected by a curved portion, one of said legs having a free end and being angled with respect to said longitudinal axis in a direction rearwardly from said free end of said metal bar, the other of said two legs being oriented approximately horizontally with said longitudinal axis and being attached to said handle by said securement means.

11. A crowbar tool as claimed in claim 10 wherein said angled element has a circular cross-section.

12. A crowbar tool as claimed in claim 10 wherein said angled element is made from metal or hard plastic material.

13. The crowbar tool as claimed in claim 10 wherein said securement means includes at least one pair of a bolt and nut.

14. The crowbar tool as claimed in claim 13 wherein said angled element is attached to one pair of said at least one pair of a bolt and nut.

15. The crowbar tool as claimed in claim 10 wherein said elongated handle has at least one permanent magnet attached thereto.

16. The crowbar tool as claimed in claim 15 wherein said at least one permanent magnet is attached to said one end of said elongated handle.

17. The crowbar tool as claimed in claim 15 wherein said elongated handle has a butt end opposite to said one end and said at least one permanent magnet is attached to said butt end of said elongated handle.

18. The crowbar tool as claimed in claim 10 wherein there is an eyelet in said elongated metal bar near said free end thereof.

19. A crowbar tool comprising an elongated metal bar attached to an elongated handle, said elongated handle having a longitudinal axis, said metal bar having a free end and a fixed end, said metal bar having a plurality of extraction teeth at said free end, said fixed end of said metal bar being attached to one end of said elongated handle by securement means, a hook being attached to said handle by said securement means and wherein said hook has a leg with a free end which leg is angled at approximately 60 degrees with respect to said longitudinal axis in a direction rearwardly from said free end of said metal bar.

20. The crowbar tool as claimed in claim 19 wherein said hook has a circular cross-section.

21. The crowbar tool as claimed in claim 19 wherein there is an eyelet in said elongated metal bar near said free end thereof.

22. The crowbar tool as claimed in claim 19 wherein said securement means includes at least one pair of a bolt and nut.

23. The crowbar tool as claimed in claim 22 wherein said hook is attached to one pair of said at least one pair of a bolt and nut.

24. The crowbar tool as claimed in claim 19 wherein said elongated handle has at least one permanent magnet attached thereto.

25. The crowbar tool as claimed in claim 24 wherein said at least one permanent magnet is attached to said one end of said elongated handle.

26. The crowbar tool as claimed in claim 24 wherein said elongated handle has a butt end opposite to said one end and said at least one permanent magnet is attached to said butt end of said elongated handle.

27. The crowbar tool as claimed in claim 19 wherein said hook is made from metal or hard plastic material.

28. A crowbar tool comprising an elongated metal bar attached to an elongated handle, said elongated handle having a longitudinal axis, said metal bar having a free end and a fixed end, said metal bar having a plurality of extraction teeth at said free end, said fixed end of said metal bar being attached to one end of said elongated handle by securement means, and an angled element having two legs which are connected by a curved portion, one of said legs having a free end and being angled at approximately 60 degrees with respect to said longitudinal axis in a direction rearwardly from said free end of said metal bar, the other of said two legs being oriented approximately horizontally with said longitudinal axis and being attached to said handle by said securement means.

29. A crowbar tool as claimed in claim 28 wherein said angled element has a circular cross-section.

30. A crowbar tool as claimed in claim 28 wherein said angled element is made from metal or hard plastic material.

31. The crowbar tool as claimed in claim 28 wherein said securement means includes at least one pair of a bolt and nut.

32. The crowbar tool as claimed in claim 31 wherein said angled element is attached to one pair of said at least one pair of a bolt and nut.

33. The crowbar tool as claimed in claim 28 wherein said elongated handle has at least one permanent magnet attached thereto.

34. The crowbar tool as claimed in claim 33 wherein said at least one permanent magnet is attached to said one end of said elongated handle.

35. The crowbar tool as claimed in claim 33 wherein said elongated handle has a butt end opposite to said one end and said at least one permanent magnet is attached to said butt end of said elongated handle.

36. The crowbar tool as claimed in claim 28 wherein there is an eyelet in said elongated metal bar near said free end thereof.

* * * * *

UNITED STATES PATENT AND TRADEMARK OFFICE

CERTIFICATE OF CORRECTION

PATENT NO. : 6,920,807 B2
DATED : July 26, 2005
INVENTOR(S) : Bond

It is certified that error appears in the above-identified patent and that said Letters Patent is hereby corrected as shown below:

The title page showing the print figure should be deleted, and replaced with the attached amended title page.

Drawing sheets, consisting of Fig. 1-4, should be deleted and replaced with the drawing sheets, consisting of Fig. 1-4, as shown on the attached pages.

Signed and Sealed this

Fifteenth Day of November, 2005

JON W. DUDAS
*Director of the United States Patent and Trademark Office*

(12) United States Patent
Bond

(10) Patent No.: US 6,920,807 B2
(45) Date of Patent: Jul. 26, 2005

(54) CROWBAR TOOL

(76) Inventor: William Ralph Bond, 4745 Asdee La., Woodbridge, VA (US) 22192

( * ) Notice: Subject to any disclaimer, the term of this patent is extended or adjusted under 35 U.S.C. 154(b) by 0 days.

(21) Appl. No.: 10/654,021

(22) Filed: Sep. 4, 2003

(65) Prior Publication Data

US 2005/0051001 A1 Mar. 10, 2005

(51) Int. Cl.[7] ..... E04D 15/00
(52) U.S. Cl. ..... 81/45; 254/131.5; 30/169
(58) Field of Search ..... 81/45; 254/131.5; 30/169, 172; 299/36.1

(56) References Cited

U.S. PATENT DOCUMENTS 178,053 A 5/1876 Frank
436,167 A 9/1890 Slocum
1,082,952 A * 12/1913 Hobbs ..... 7/143
3,228,720 A * 1/1966 Jordan ..... 294/65.5
5,280,676 A * 1/1994 Fieni ..... 30/172
D439,126 S * 3/2001 Gohman ..... D8/89
D444,690 S 7/2001 Bond
6,453,774 B1 * 9/2002 Khachatoorian ..... 81/45

* cited by examiner

*Primary Examiner*—Joseph J. Hail, III
*Assistant Examiner*—Alvin J. Grant
(74) *Attorney, Agent, or Firm*—Palmer C. DeMeo

(57) ABSTRACT

A crowbar tool is disclosed for construction use and particularly for carpentry and roofing work. The crowbar tool has an elongated metal bar with a plurality of extraction teeth at one end of the metal bar and a handle to which the opposite end of the metal bar is attached. Attached to the handle, near the attachment of the metal bar, is a hook or angled element which hook or angled element facilitates the removal of shingles, tiles and carpets whereby, during their removal process, they slide over the hook or angled element without being obstructed by the handle. The crowbar tool also has several permanent magnets attached to the handle thereof for picking up loose nails, staples or other small metal objects.

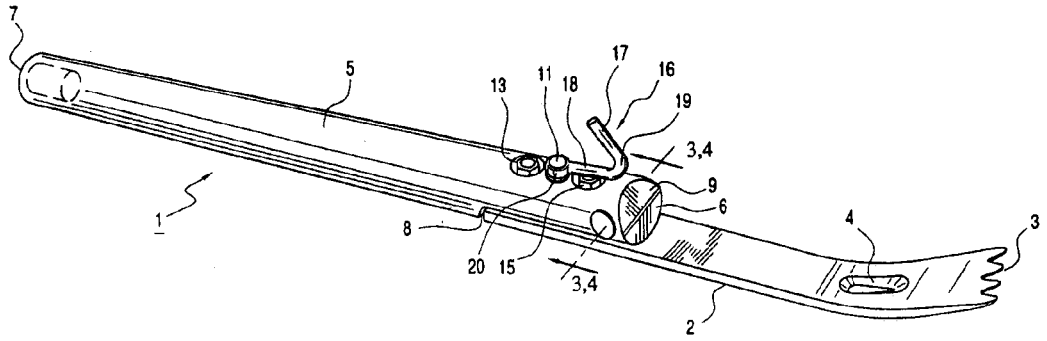

36 Claims, 2 Drawing Sheets